US006682445B1

(12) United States Patent
Tanner

(10) Patent No.: US 6,682,445 B1
(45) Date of Patent: Jan. 27, 2004

(54) DURABLE BATTING TEE FOR BASEBALL

(76) Inventor: Joe H. Tanner, 3918 Meadow Creek La., Sarasota, FL (US) 34233

( * ) Notice: Subject to any disclaimer, the term of this patent is extended or adjusted under 35 U.S.C. 154(b) by 0 days.

(21) Appl. No.: 10/298,857

(22) Filed: Nov. 18, 2002

(51) Int. Cl.[7] ..... A63B 71/00
(52) U.S. Cl. ..... 473/417
(58) Field of Search ..... 473/417, 419, 473/420, 422, 451

(56) References Cited

U.S. PATENT DOCUMENTS 3,883,138 A * 5/1975 Chorey ..... 473/417
5,076,580 A * 12/1991 Lang ..... 473/417
5,580,047 A * 12/1996 Shih et al. ..... 473/417
5,848,945 A * 12/1998 Miller et al. ..... 473/417
6,358,163 B1 * 3/2002 Tanner ..... 473/417

* cited by examiner

*Primary Examiner*—Paul T. Sewell
*Assistant Examiner*—Nini F. Legesse
(74) *Attorney, Agent, or Firm*—Akerman Senterfitt; Michael C. Ceserano

(57) ABSTRACT

An improved batting tee uses an elongated split washer to provide friction between telescoping parts in the stem without requiring tightening adjustments by a user, an elongated rounded grommet at the top of the tee to provide stability for the grommet and protection for the ball holder against cuts made by the bat hitting the ball holder against the top end of the innermost telescoping member, and a ball holder made from a wound, flexible material that retains its shape and resiliency without requiring a threaded member to hold the windings together.

4 Claims, 9 Drawing Sheets

DURABLE BATTING TEE FOR BASEBALL

BACKGROUND

This invention is an improvement,for a batting tee for baseball as disclosed in U.S. Pat. No. 6,358,163 to Tanner.

A batting tee is used by baseball players to practice hitting baseballs held at various positions within or near to the strike zone. By using a batting tee to practice hitting a stationary ball, players can improve their batting swings and learn to hit balls from various locations within and near to the strike zone. Because many players wish to practice hitting balls from locations that are awkward or unfamiliar to them, or from which the player has previously experienced difficulty hitting a ball, it is a common accident for players to strike the batting tee with the bat, rather than hitting the baseball held atop the tee. The result is that batting tees typically suffer tremendous physical abuse throughout their lives.

U.S. Pat. No. 6,358,163 discloses a durable batting tee having a number of specialized features intended to avoid wear, tear, and breakage to which a typical batting tee is subjected. Amongst these features are a split washer that is used within a nut and threaded compression fitting to enable a batter to tighten the split washer about the tee to hold the ball at a desired height. The compression fitting was used to enable the tee to withstand impacts from a bat, yet still be able to be tightened sufficiently to hold the telescoping members at a desired position. Although this feature works well for its purpose, it does have the drawback of requiring a batter to twist the compression fitting in order to loosen it for adjustment of the telescoping member, and to twist it in the opposite direction to tighten the fitting when the proper height is obtained.

The top of the tee disclosed in U.S. Pat. No. 6,358,163 is shown as having a grommet having a rounded top surface and extending a short distance into the topmost portion of the uppermost telescoping member. This configuration prevents the flexible cone-shaped ball holder from splitting from the force of a baseball bat hitting it against the rigid upper portion of the uppermost telescoping member. However, the grommet may, after repeated impacts, become loose and separate from the upper telescoping member, being knocked out of the batting tee or otherwise become lost.

The strand that is drawn through the flexible ball holder serves the purpose of maintaining the wrapped, flexible sheet in a frusto-conical shape while still allowing the ball holder to be deformed when struck by a baseball bat. However, after repeated strikings, the strand has been observed to cause a small rent, or tear in the area of the ball holder through which the strand is threaded. With repeated use, this tear can become enlarged, resulting in a loss of structural integrity of the ball holder and a need to rebuild the ball holder and reattached it to the batting tee.

These problems, which have become apparent only through rugged use of the batting tee by professional baseball teams, are corrected in the improved durable baseball tee that is the subject of this invention.

SUMMARY AND OBJECTS OF THE INVENTION

This invention uses an improved structure for holding two telescoping pieces in a set relationship without the need for a threaded compression fitting. In the prior art, a compression fitting has applied tightening friction about an inner telescoping member using a split washing having some flexibility. This invention uses an elongated split washer having an external, circumferential flange, to provide sufficient friction to hold an inner-telescoping member within an outer one. The elongated split washer fits within the uppermost portion of the outer telescoping member for a short distance which may be between about one-half inch to about two inches, depending upon the coefficient of friction at the interface of the inner surface of the washer and the outer surface of the inner telescoping member. The washer is slightly flexible, and is split to enable it to be squeezed against the inner telescoping member. The washer has an external flange about its circumference at the upper end to prevent the washer from slipping completely within the outer telescoping member. Although washers found in the prior art may be elongated or have flanges, they are not split and do not have the ability to apply friction through circumferential squeezing. When the washer of this invention is used, a sufficient squeezing force may be applied by encasing the washer and uppermost portion of the outer telescoping member within a standard rubberized or other flexible support piece. The support piece may be similar to rubber or nylon protectors used on metal furniture legs to protect the floor from scratches with the, exception that the support piece used for the batting tee will have an opening at either end through which a telescoping member will be inserted. The support piece may also have inner circumferential ridges to assist in gripping the outer telescoping support member to which it is attached.

The support piece exerts a circumferential squeezing force upon the elongated split washer, holding the washer against the inner telescoping member with sufficient pressure to prevent slippage between them. Because the elongated washer has a greater surface area in contact with the inner telescoping member than does the split washer disclosed in U.S. Pat. No. 6,358,163, it is not necessary to apply the force of a threaded compression washer to prevent slippage. Rather, the circumferential pressure applied by the flexible support piece is sufficient to prevent slippage between the washer and the telescoping member until extra force is applied longitudinally to the inner telescoping member by the batter to cause the inner telescoping member to be moved and repositioned.

The flexible grommet at the top of the uppermost telescoping member may be provided with additional support against working loose by elongating the grommet to extend into the upper portion of the uppermost telescoping member for a distance substantially greater than that disclosed in U.S. Pat. No. 6,358,163. An elongated grommet that fits snugly within the uppermost telescoping member experiences additional side support that prevents it from wobbling within the tee when struck with a bat. Additional friction due to the larger surface interface between the grommet and the interior surface of the uppermost telescoping member keeps the grommet from being pulled out of the upper telescoping member. The elongated grommet is substantially less likely than the prior art grommet to separate from the tee or to become unstable when repeatedly hit with a baseball bat.

It has also been discovered that a properly shaped and wrapped flexible sheet may be used to hold the baseball without the necessity of having a flexible strand be threaded through the sheet. The elimination of the flexible strand also eliminates the likelihood that the ball holder will rip or tear after repeated strikings with a baseball bat, with the result that the ball holder will have to be repaired or rebuilt less frequently than the ball holder disclosed in U.S. Pat. No. 6,358,163.

It is an object of this invention to make an improved batting tee that does not require a threaded compression coupling, to maintain, throughout the life of the batting tee, an appropriate amount of friction such that two telescoping members can be set in a desired position. It is another object of the invention to prevent a flexible ball holder from becoming split when struck by a bat at the upper end of the uppermost telescoping member by using an elongated grommet that will not separate from the tee. It is yet another object of the invention to configure a ball holder to a frusto-conical shape without subjecting the sheeted material to rents and tears caused by having a flexible strand be threaded through the sheets of material. It is still a further object of this invention to combine these improvements into an improved batting tee that will withstand rugged use for a period of years without breaking or requiring substantial repair.

DETAILED DESCRIPTION OF THE DRAWINGS AND PREFERRED EMBODIMENTS

Figure 1:
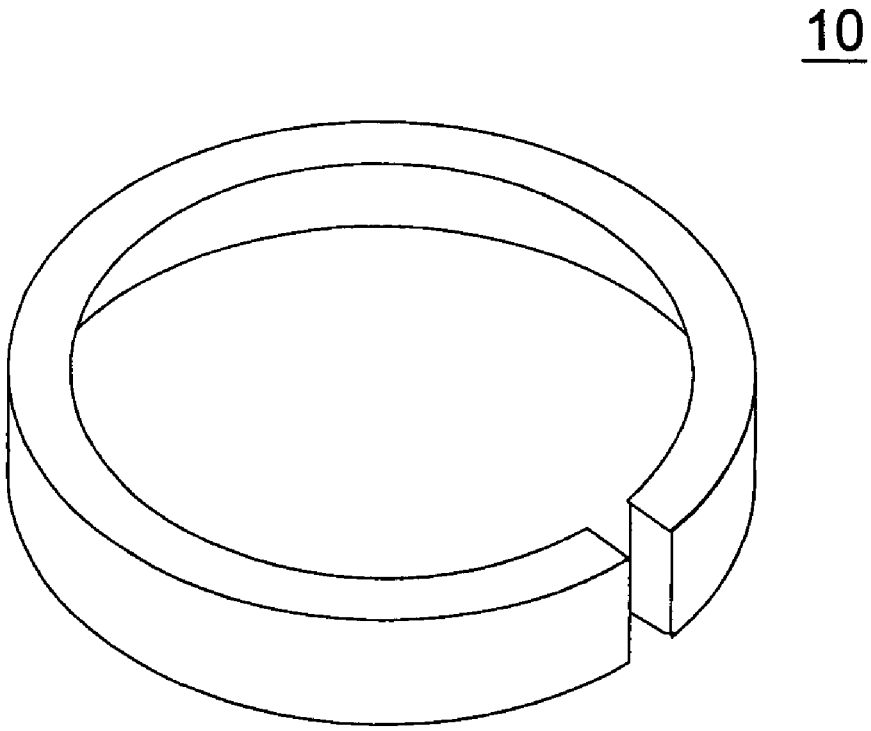
Prior Art FIG. 1
FIG. 1 is a perspective view of the split washer that is found in the prior art.

The prior art split washer 10 is shown in FIG. 1. As disclosed in U.S. Pat. No. 6,358,163, the washer is placed around a telescopic member and squeezed to create friction with the surface of the member when a threaded compression fitting is tightened. Although washer 10 is adequate to hold a telescoping member in a desired position, it has the drawbacks that it does not stabilize the inner telescoping member within the outer telescoping member; and it requires a batter to turn the threaded compression fitting in order to tighten or loosen the washer when the telescoping members are being adjusted. In addition, if the prior art washer is squeezed sufficiently to fit within the outer telescoping member, there is nothing to hold it vertically, and it may slip farther down into the outer telescoping member and no longer carry out its purpose.

Figure 2:
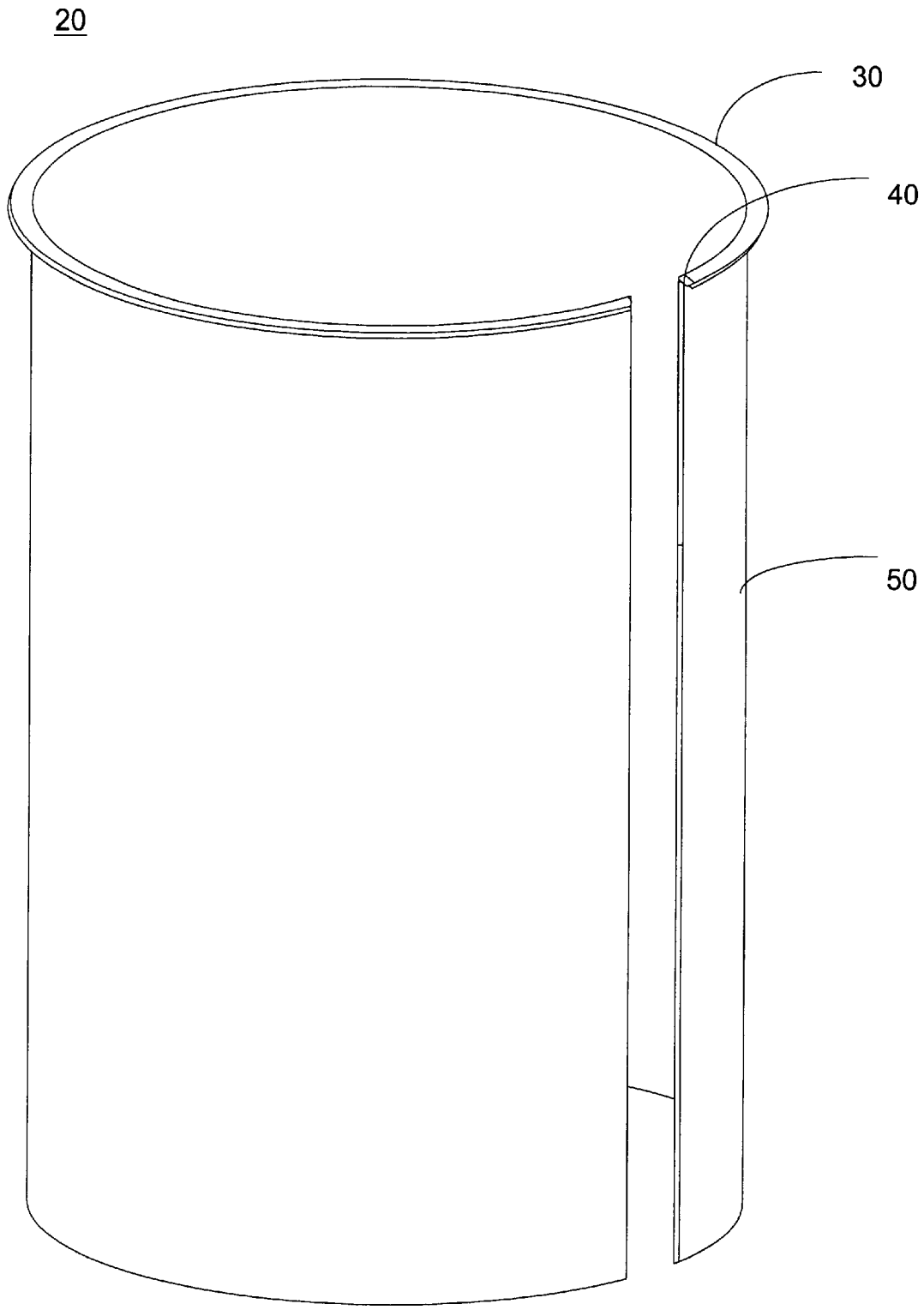
FIG. 2 is a perspective view of the elongated, flanged, split washer of the invention.

The improved split washer of this invention 20 is depicted in FIG. 2. Because it is elongated, it has a greater surface area in contact with the inner telescoping member, and requires less squeezing pressure to hold the inner telescoping member in a desired position. Upper circumferential flange 30 is located just above the top of the uppermost end of the outer telescoping member and provides a lip that will not permit the elongated washer to slip down into the outer telescoping member. The elongated portion 50 below the flange does fit down into the upper end of the outer telescoping member and provides support against side impacts imparted by a bat against the inner telescoping member. The split 40 permits the elongated split washer to be squeezed to create friction between itself and the upper telescoping member.

Figure 3:
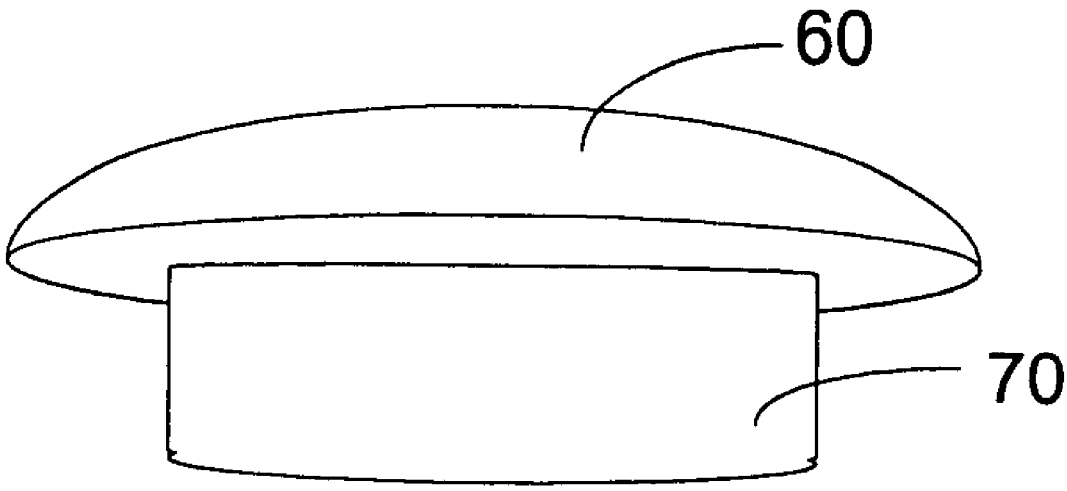
Prior Art FIG. 3
FIG. 3 is a perspective view of the grommet used in the prior art.

FIG. 3 shows a prior art grommet that is used to protect the conical ball holder from being ripped when a bat hits the ball holder in the vicinity of the uppermost telescoping member. The rounded head 60 may be slightly flexible, and presents a smooth, rather than sharp, surface against which the ball holder is impacted. However, the prior art grommet depicted in FIG. 3 has a short shaft 70, and therefore lacks stability and generates insufficient friction to maintain the grommet in the upper telescoping member if the grommet should be struck by a bat.

Figure 4:
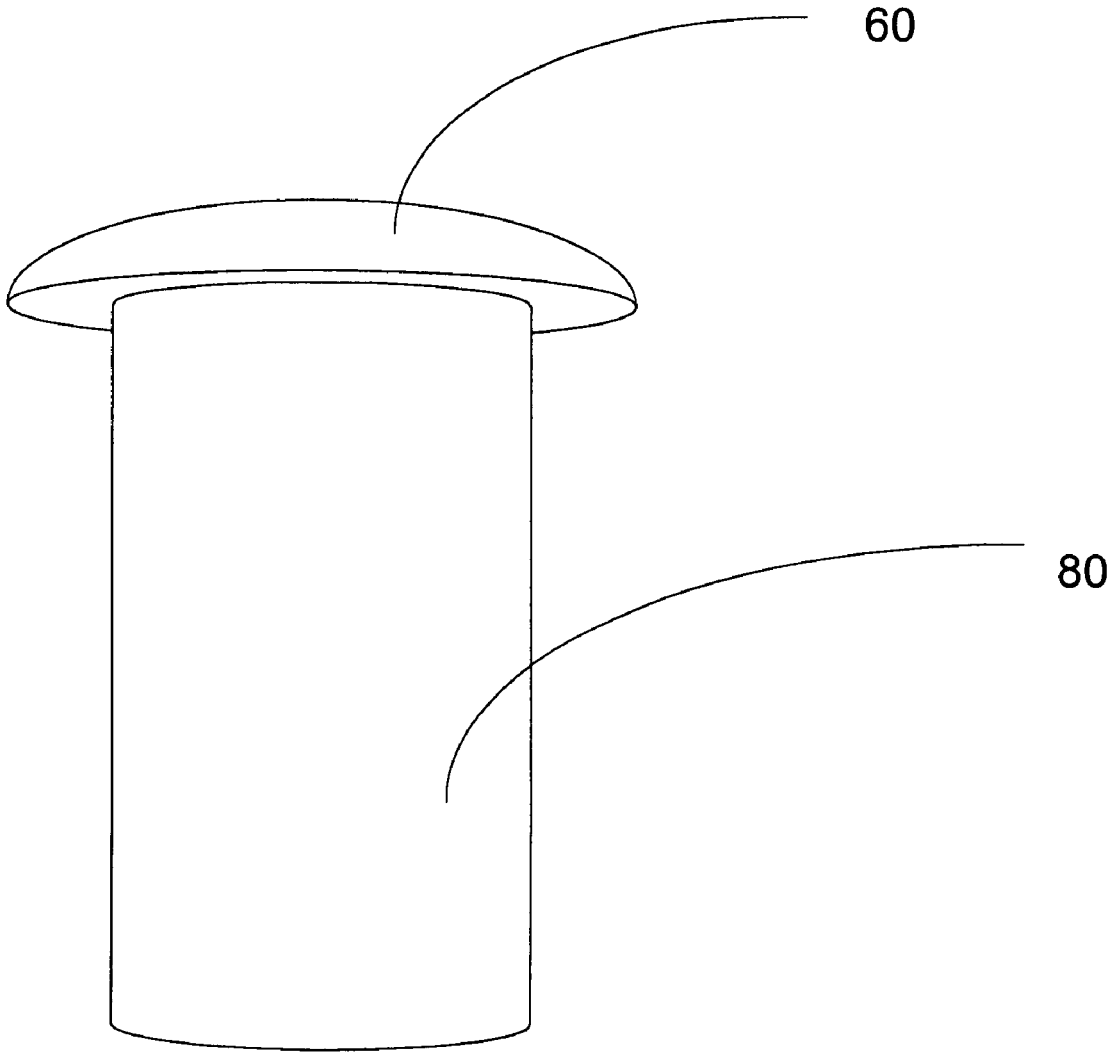
FIG. 4 is a perspective view of the grommet of the invention.

An improved grommet is shown in FIG. 4. While the curved head 60 remains unchanged, an elongated shaft 80 provides support against wobbling if the grommet is struck by a bat, and generates sufficient friction to hold the grommet within the uppermost portion of the uppermost telescoping member.

Figure 5:
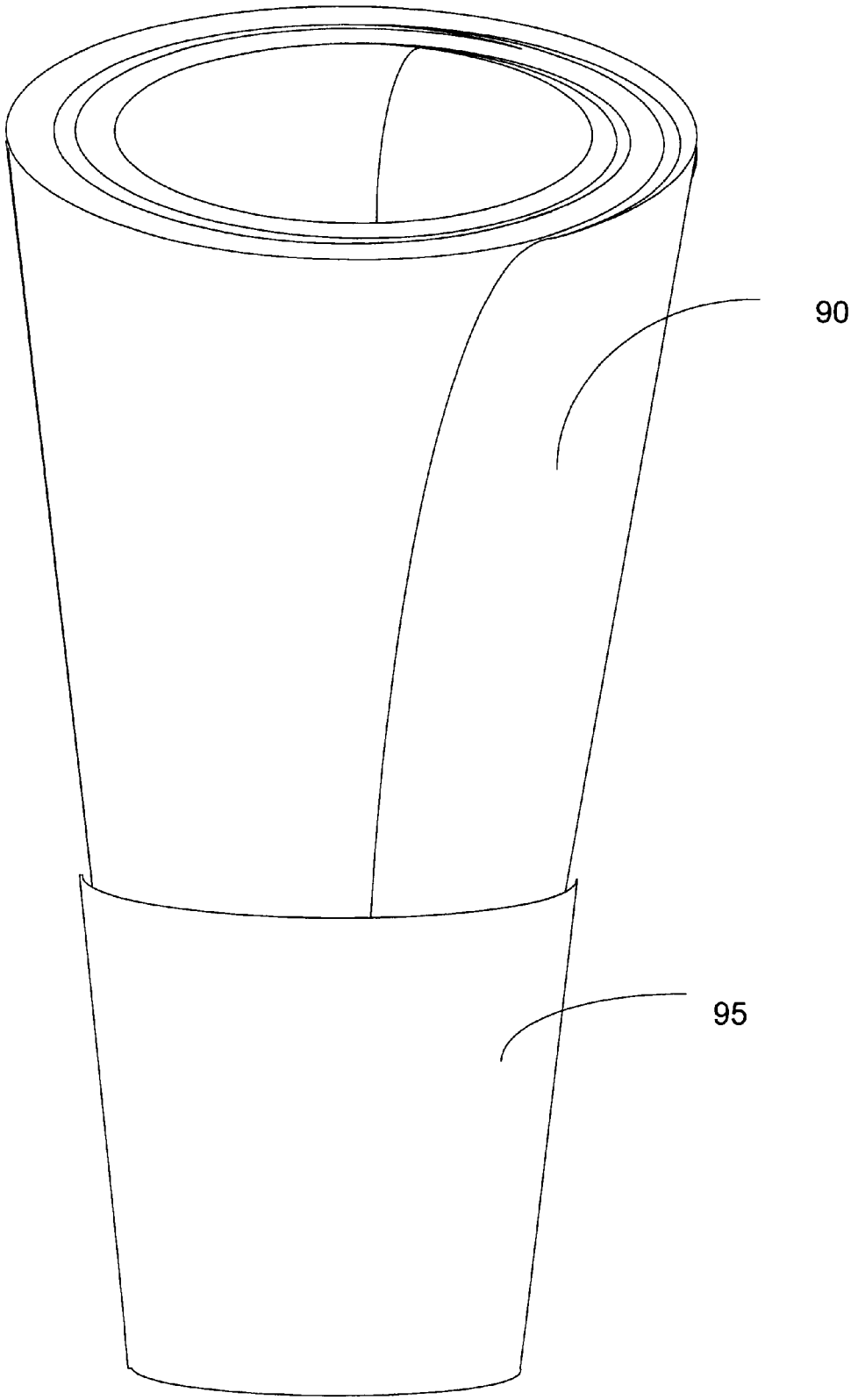
FIG. 5 is a perspective view of the ball holder of this invention.

An improved ball holder is depicted in FIG. 5. As can be seen, sheeting material 90 is wound, or wrapped, to form a frusto-conical shape. When a batter strikes below the ball being held by the ball holder, the, ball holder can collapse without losing its resilience or shape. The prior art ball holder disclosed in U.S. Pat. No. 6,358.163, also used a wound sheeting material, but was held to a frusto-conical shape by threading a flexible strand through the material. When the prior art ball holder was subjected to extensive use, it became apparent that the flexible strand was causing rips and tears to form in the sheeting material. The problem may be alleviated by omitting the strand from the ball holder and providing an elastic wrapping 95 around the base of the ball holder that extends slightly above the height of the grommet atop the uppermost telescoping member. The improved ball holder, no longer constrained by the flexible threaded strand, can be hit or impacted from virtually any direction without causing damage to the ball holder.

Figure 6:
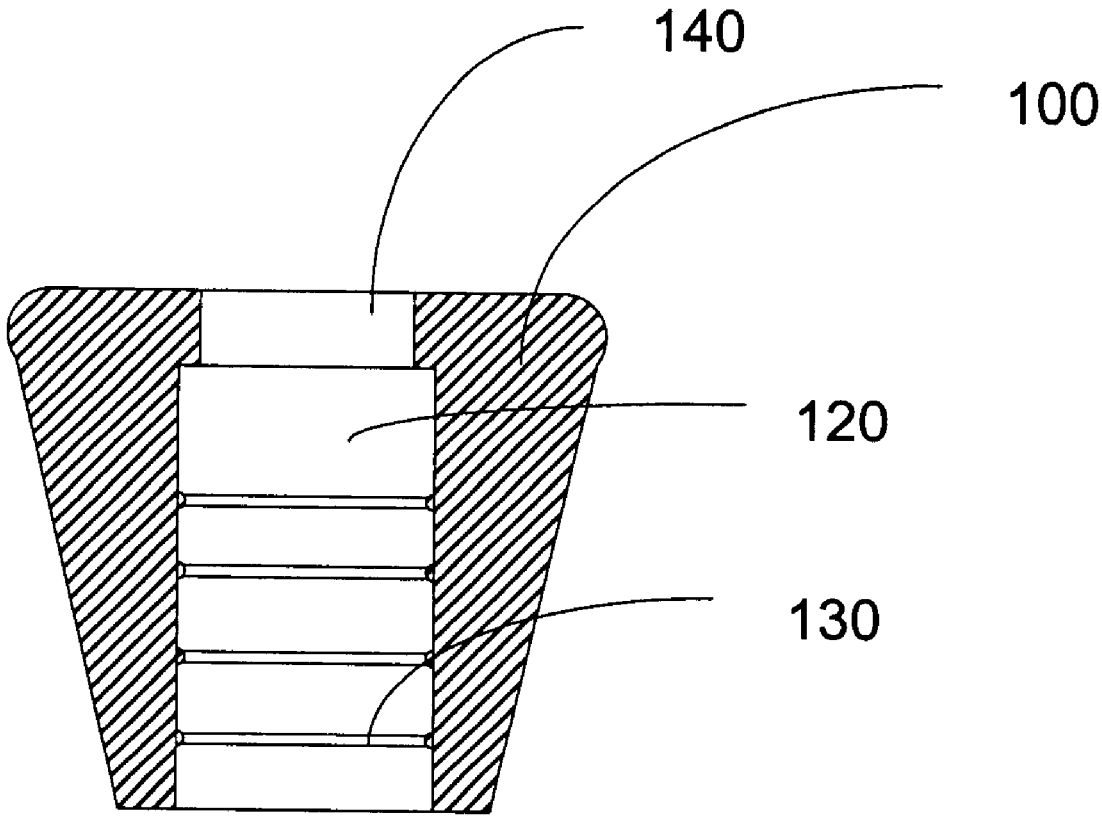
FIG. 6 is an front sectional view of the support piece of the invention.

FIG. 6 depicts the support piece 100 that fits over an outer telescoping member and supports an inner telescoping member. The support piece has a large cavity 120 opening downwardly, within which will fit the uppermost portion of an outer telescoping member. A smaller cavity 140 is located at the, upper end of support piece 100, and receives the inner telescoping member. Within cavity 140, the inner telescoping member may slide to be positioned at any desired height with respect to the outer telescoping member. Interior ridges 130 provide an uneven surface where support piece 100 is fitted over the upper end of the outer telescoping member, and promote the adherence of the support piece to the outer telescoping member. This joiner between the support piece and the outer telescoping member may be further enhanced by wrapping the upper end of the outer telescoping member with a fabric tape having a rough outer surface. If desired, a glue may be used to cause the support piece to adhere to the outer telescoping member. However, if glue is used, it may require the support piece to be destroyed if its removal should be necessary to perform maintenance upon the batting tee.

Figure 7:
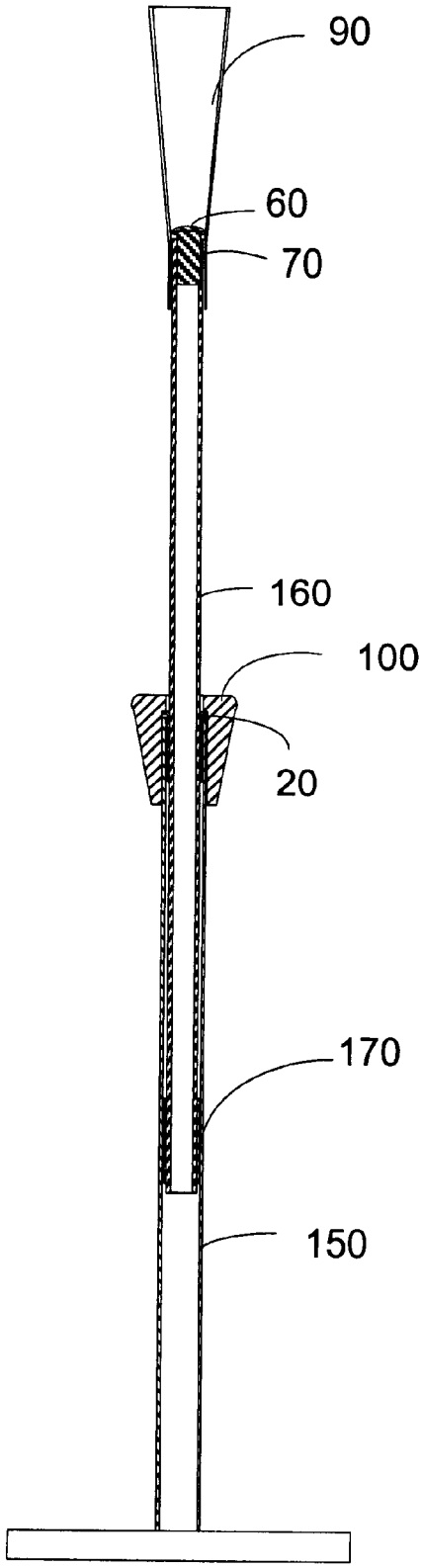
FIG. 7 is a front sectional view of the improved batting tee.

FIG. 7 depicts an assembled batting tee of the invention. An outer telescoping member 150 is attached to a base. Inner telescoping member 160 fits within outer telescoping member 150 to create an extensible batting tee. The lower end of inner telescoping member 160 has a sleeve 170 at the lower end to ensure that the range of lateral movement of the lower end of inner telescoping member 160 is minimized.

As shown in FIG. 7, ball holder 90 is located at the upper extremity of the inner telescoping support member, and elongated grommet 70 presents a smooth, rounded head 60 to the innermost wrapping surface of the ball holder.

Figure 8:
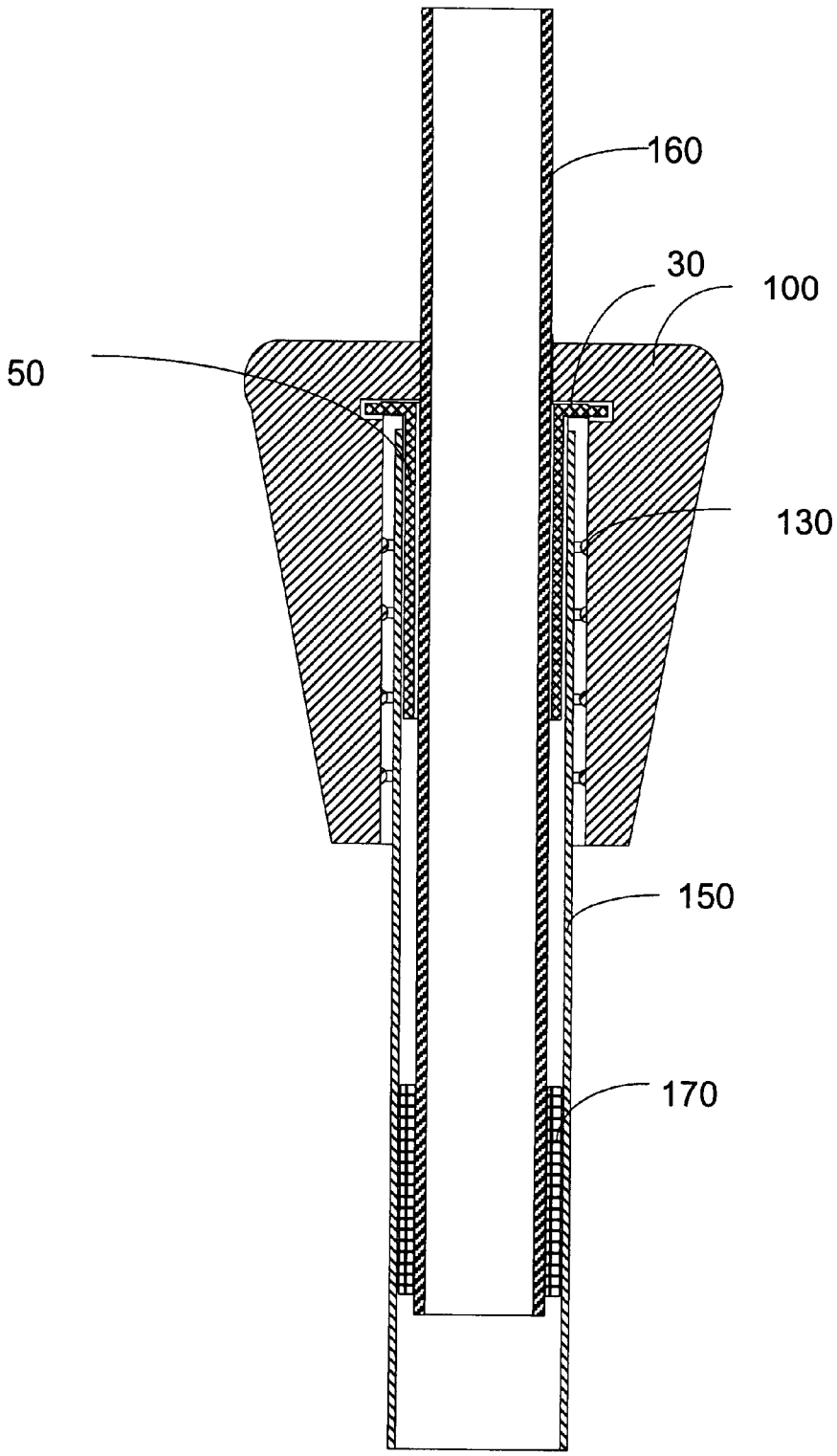
FIG. 8 is an enlarged sectional view of the interface between an outer telescoping member and an inner telescoping member.

An expanded view of the joining section is depicted in FIG. 8. Here may be seen inner telescoping member 160 being held within outer telescoping member 150. Sleeve 170 fits over the lower end of inner telescoping member 160, and within the outer telescoping member 150 to provide a close fit within outer telescoping member 150 and to restrict movement of the lower end of inner telescoping member 160 when the upper end is struck by a bat. Support piece 100 fits over the upper end of outer telescoping member 150, and contacts the flange 30 of elongated split washer 20, causing it to contract slightly and produce friction at the interface between the washer and the inner telescoping member. The elongated portion 50 of elongated split washer 20 extends downwardly into the upper portion of outer telescoping member 150. Flange 30 prevents the elongated split washer 20 from slipping completely downward within outer telescoping member 150. Inner telescoping member 160 fits within outer telescoping member 150, and is held within and supported by elongated split washer 20. Friction between the inner surface of elongated split washer 20 and inner telescoping member 160 holds the inner and outer telescoping members in position relative to one another. Elongated split washer 20 is caused to squeeze against inner telescoping member by the inner surface of the larger cavity 120 of support piece 100 pressing against flange 30. Inner ridges 130 grip the outer surface of outer telescoping member 150, and hold support piece 100 firmly in place. By varying the size of the split 40 in elongated washer, the length of the elongated portion 50 of the elongated washer, the outer diameter and surface texture of inner telescoping member, and the size and resilience of support piece 100, an appropriate amount of friction can be developed for holding inner telescoping member 160 within outer telescoping member 150 during a batting session, while still allowing sufficient sliding movement to occur when it is desired to raise or lower the positioning of the ball holder.

Figure 9:
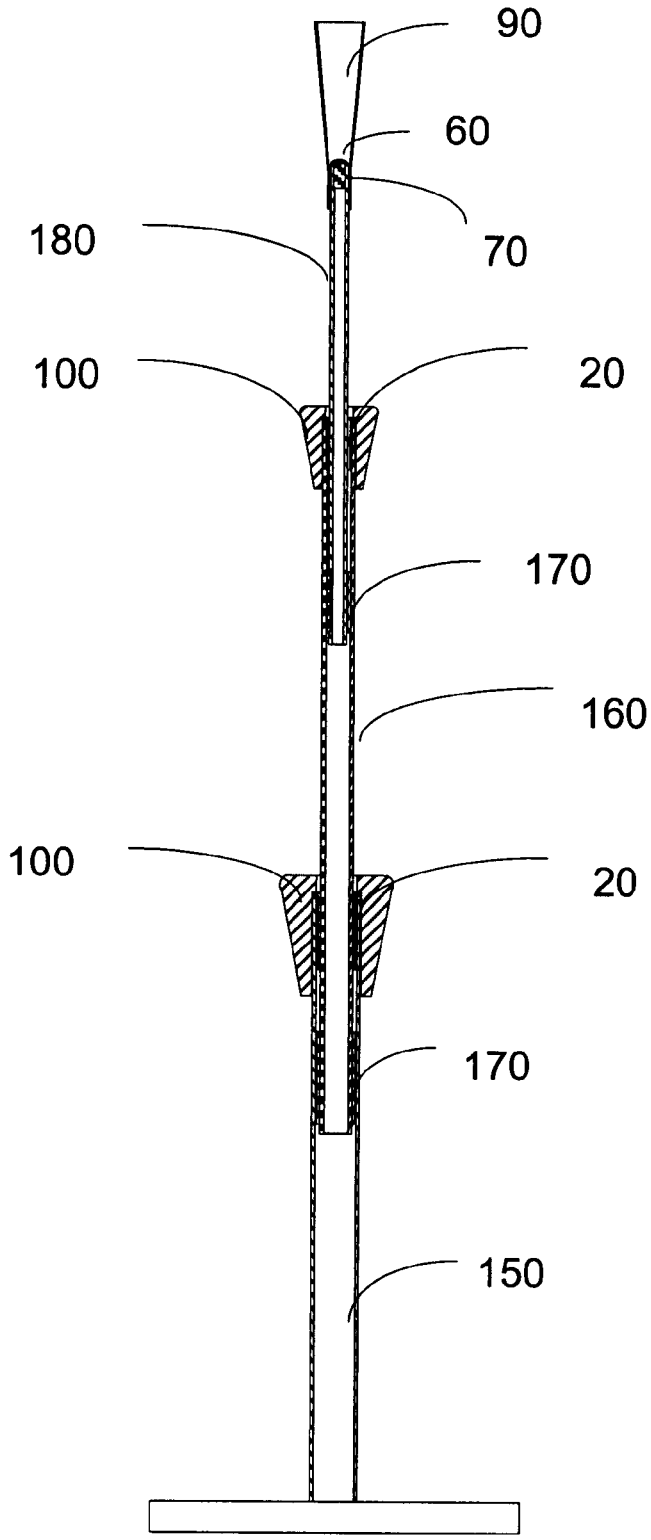
FIG. 9 is an improved batting tee having three telescoping members.

In FIG. 9, an improved batting tee having three telescoping members is shown. This embodiment provides a maximum height differential between the lowest positioning of the ball holder and the highest positioning of the ball holder. The only difference between a batting tee having two telescoping members and the tee shown in FIG. 9 is that a second joining section is used to hold and support the additional telescoping member. Thus, in FIG. 9, a third telescoping member 180 fits within telescoping member 160. The support piece 100 and elongated split washer 20 operate in the same fashion and are identical to those shown in FIG. 7 except with respect to size.

One advantage of the improved batting tee of this invention is that it has been designed using components that are easily available to consumers and that require no specialized manufacturing or machining. For example, wound ball holder 90 may be fashioned from the inner tube material used in truck tires. Elongated grommet 80 having a rounded head 60 may be fashioned from a tire stem used to inflate an automobile or truck tire. The elastic support 95 for the ball holder may be made from the inner tube of a bicycle tire. Support piece 100 may be formed from a protective tip for covering the lower end of a furniture leg. Elongated split washer 20 may be fashioned from nylon or PVC piping material, and the base of the tee may be cut from a sheet of plywood. Telescoping members may be formed from metal piping.

Although the present invention has been particularly shown and described with reference to a preferred embodiment, it will be understood by those skilled in the art that various changes in form and detail may be made without departing from the spirit and scope of the invention.

What is claimed is:

1. An improved batting tee comprising:

an upper and a lower telescoping member, said upper and lower telescoping members each having an upper end and a lower end, said lower end of said upper telescoping member fitting through an elongated split washer, said elongated split washer being split longitudinally and having a flange and an elongated portion, said elongated portion below said flange fitting into said upper end of said lower telescoping member to create a snug fit, said flange extending outwardly from said elongated portion such that said elongated split washer cannot fit entirely within said lower telescoping member, a support piece having an opening therethrough, said opening comprising a larger cavity and a smaller cavity, said upper end of said lower telescoping member fitting snugly within said larger cavity, said upper telescoping member fitting snugly and extending through said lower cavity, an inner surface of said support piece contacting at least a portion of said flange to cause said elongated split washer to compress sufficiently to create friction at the interface of the inner surface of said elongated split washer and the outer surface of said upper telescoping member, a grommet, said grommet being inserted into said upper end of said upper telescoping member and having an elongated shaft extending into said upper telescoping member for a distance of not less than about 1.5 cm, a frusto-conical ball holder being attached at said upper end of said upper telescoping member and being formed of a sheet of flexible material that is rolled into a frusto-conical shape, said frusto-conical ball holder being supported at said upper end of said upper telescoping member, said flexible material having sufficient rigidity to maintain said frusto-conical shape without additional support.

2. An improved batting tee as claimed in claim 1 further comprising a third telescoping member.

3. An improved batting tee as claimed in claim 1 further comprising support means located adjacent said lower end of said upper telescoping member, said support means further comprising a sleeve attached to said lower end of said upper telescoping member, said sleeve being disposed to, reduce lateral movement of said lower end of said upper telescoping member when said batting tee is struck with a bat.

4. An improved batting tee as claimed in claim 1 wherein said support piece further comprises inner ridges situated circumferentially within said larger cavity.

* * * * *